United States Patent [19]

Brenholt et al.

[11] Patent Number: 4,484,860

[45] Date of Patent: Nov. 27, 1984

[54] RADIAL TUBE CENTRIFUGAL FAN

[75] Inventors: David L. Brenholt, Menomonie, Wis.; Paul M. Fischer, Apple Valley, Minn.; Kenneth V. Mattson, Menomonie, Wis.

[73] Assignee: Donaldson Company, Inc., Minn.

[21] Appl. No.: 379,256

[22] Filed: May 17, 1982

[51] Int. Cl.[3] ..... F04D 29/20

[52] U.S. Cl. ..... 416/182

[58] Field of Search ..... 416/186 R, 179, 181, 416/182, 183, 184, 185; 29/156.8 CF

[56] References Cited

U.S. PATENT DOCUMENTS

| | | | |
|---|---|---|---|
| 1,928,075 | 9/1933 | Replogle . | |
| 2,074,650 | 3/1937 | Holdaway | 416/179 |
| 2,366,251 | 1/1945 | Füllemann | 416/182 UX |
| 2,462,392 | 2/1949 | Hautau . | |
| 2,625,365 | 1/1953 | Moore . | |
| 2,782,722 | 2/1957 | Chubbuck | 416/181 |
| 3,175,757 | 3/1965 | Laing . | |
| 3,224,078 | 12/1965 | Mayne . | |
| 3,224,079 | 12/1965 | Dybvig | 416/186 X |
| 3,285,187 | 11/1966 | Anderson, Jr. . | |
| 3,362,338 | 1/1968 | Stethem | 416/183 |
| 3,521,973 | 7/1970 | Schouw | 416/185 |
| 3,953,147 | 4/1976 | Aspinwall | 415/183 X |
| 4,012,166 | 3/1977 | Kaesser et al. | 415/181 |
| 4,155,151 | 5/1979 | Stiegelmeier | 416/184 X |

FOREIGN PATENT DOCUMENTS

| | | | |
|---|---|---|---|
| 80110 | 2/1963 | France | 416/179 |
| 2040531 | 1/1971 | France | 416/185 |
| 145005 | 11/1979 | Japan | 29/156.8 CF |
| 813133 | 5/1959 | United Kingdom | 416/186 |
| 578478 | 10/1977 | U.S.S.R. | 416/186 |

*Primary Examiner*—Robert E. Garrett
*Assistant Examiner*—Joseph M. Pitko
*Attorney, Agent, or Firm*—Merchant, Gould, Smith, Edell, Welter, & Schmidt

[57] ABSTRACT

A radial tube centrifugal fan is disclosed. The fan is assembled from a first mating half (12) having a planar backing plate (16) with a group of half tubes (52) extending in spoke-like fashion from the plate and separated by webbing members (56), attached to a second mating half (14) having an axial inlet opening (18) and a like group of half tubes (54) and webbing members (58). The assembled fan has an inlet port (18) and a plurality of radially extending outlet tubes (26) formed from the mating half tubes and which are curved in a direction away from the preferred direction of fan rotation.

3 Claims, 7 Drawing Figures

FIG. 1
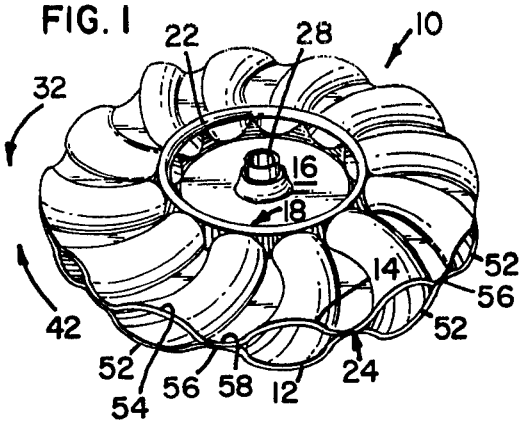
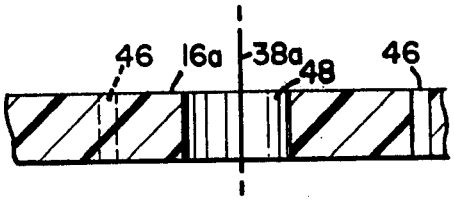
FIG. 4
FIG. 3
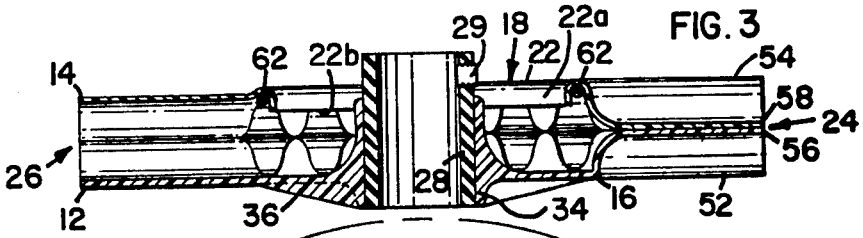
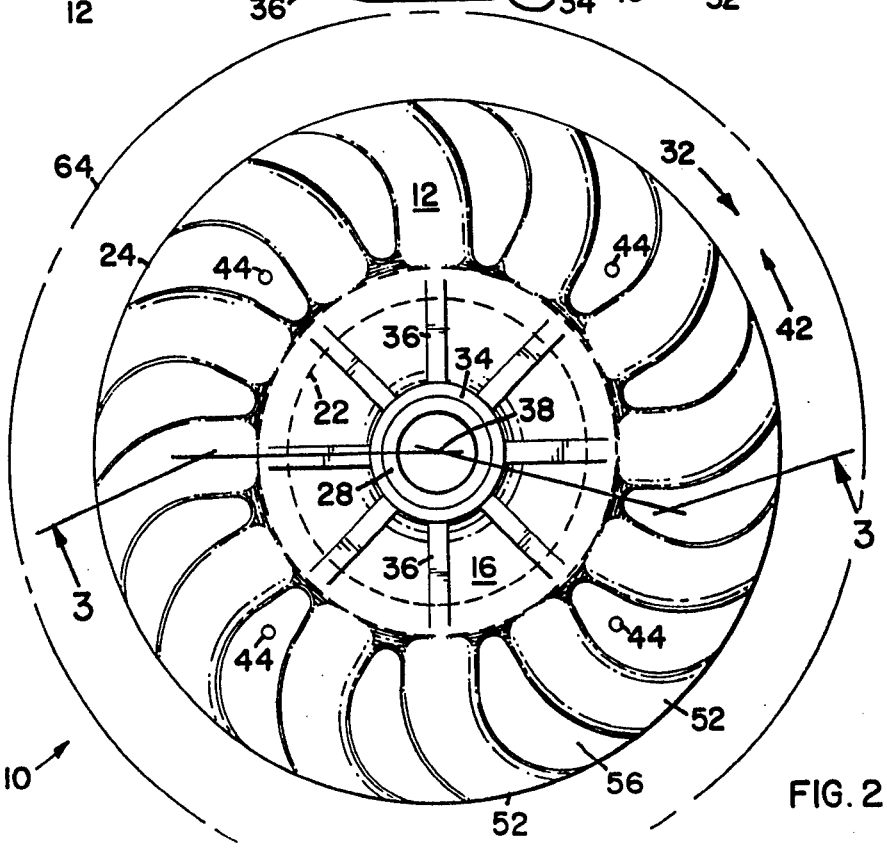
FIG. 2

RADIAL TUBE CENTRIFUGAL FAN

TECHNICAL FIELD OF THE INVENTION

The invention relates generally to the field of fluid pumps, and more specifically to a fan or impeller used for moving air through a conduit. Such a fan could be successfully employed in a vacuum cabinet or cleaner, or a device for passing air through a filter. The invention can also be successfully employed in any type of blower, or where there is a need to move air or fluid.

BACKGROUND OF THE INVENTION

Many types of fans, rotors, and impellers are known. One common type of fan is the squirrel cage blower which is commonly used to move air through conduits. Another common device for moving fluid is the common axial blade fan which has radially extending propeller blades. An example of this latter device is the common room fan for moving air within a room.

The use of rotors having fins or blades of various configurations and designs is known. Typically, these machines have either open blades for moving air parallel to the axis of rotation of the fan, or have enclosed passageways of square or rectangular cross section. Typically, a fan having enclosed passageways will move air in a direction perpendicular to the axis of rotation of the fan after drawing air towards the rotor in a direction parallel to the axis of rotation. Rectangular passageways have a higher ratio of surface area to volume than do circular passageways. For this reason, the rectangular passageway design necessitates a fan having a higher weight than a fan having passageways of circular cross section construction of the same material and capable of moving the same volume of air.

Additional disadvantages of the fans known in the prior art include the use of metallic materials for constructing the fan. Metal fans lead to the possibility of sparks being generated by the fan, which is a severe safety hazard in dusty environments. Also, some metals are not resistant to certain corrosive chemicals such as acids which may be present in the air being moved by the fan. Additionally, metals often have a higher density than other materials and therefore may produce a heavier fan of a given dimension. The fabrication of metal fans typically produces sharp edges and burrs which are dangerous to handle and frequently catch dust and lint from the environment reducing the efficiency of the rotor.

The fabrication methods commonly used to manufacture fans and rotors often produce a product having significant disadvantages. Often, fans are produced from thin metal stock through a stamping process, or a heavier fan is produced by casting the fan components. Some fans are constructed of multiple components which must be satisfactorily connected. Frequently employed connectors include welding, glueing, and forming tabs in one piece of the rotor which are inserted through slots in another piece of the rotor and then bent to prevent removal. The development of economical and satisfactory connection techniques is a significant problem in the art, because the finished fan must be lightweight yet strong enough to withstand the forces exerted upon it during high speed rotation.

Typical solutions to the problems encountered in moving large volumes of air have included the use of larger fans or rotors, turning the presently existing fans at higher speeds and attempting to produce more efficient fans. The first two solutions are expensive and potentially dangerous, as large or fast moving fans have a greater chance of deforming or breaking apart. Therefore, there is a need for an efficient fan capable of moving a sufficient volume of air while being of managable size, and operating at a safe speed.

SUMMARY OF THE INVENTION

The invention resides in a radial tube centrifugal fan having radial tubes of circular cross section. The fan is assembled from two pieces, one having a backing plate for attachment to a motor forming roughly one-half of the tubes. Webbing lies between these half portions of the tubes rigidly fixing their positions. The second piece of the fan contains an entry port opening located in the center of the piece, and contains half portions of the tubes corresponding to the half tube portions on the other piece of the fan. Additional webbing is provided between the half tube portions on the second piece, this webbing is then bonded or joined to the webbing on the first piece forming a fan with tubes of circular cross section. The resulting fan includes a backing plate and an entry port opening with tubes located between the entry port and the backing plate by webbing structures, and the fan pieces are connected together by the webbing.

The present invention comprises a fan constructed as described above, and manufactured from a synthetic resin of plastic material such as acrylonitrile butadiene styrene (ABS), or fiber reinforced plastic (FRP) or similar material. These plastics can be easily molded and chemically bonded together and can produce a fan having a very smooth interior surface which will not catch dust or dirt from the air. The entry port is formed having a bell flange or smoothly curved opening which helps improve the aerodynamic flow of air passing through the entry port. Additionally, the bell flange is reinforced with a metal ring or glass fiber embedded below the surface of the bell flange, which serves to reinforce and strengthen the entry port. The use of plastic produces a nonsparking fan which will not react to corrosive elements, and which is of light weight yet of strong construction.

An important feature of the invention is disclosed when it is understood that by employing tubes of circular cross section the highest possible ratio of volume to surface area of the tubes is achieved, thus producing a fan capable of moving a greater volume of air while having the lightest possible overall weight.

It should be understood that the invention can be successfully practiced by constructing the fan from other materials such as metal, ABS, nylon, graphite or the like. The use of FRP plastic, however, proves especially satisfactory because of its strength, light weight, smooth finish, and its ability to be easily reinforced where needed.

The rotor is constructed by forming oversized pieces to the appropriate shapes using a mold or form, cutting the necessary openings in the pieces, bonding the two pieces together with glue, solvent or rivets, and cutting the assembled rotor to the desired diameter. In this way a single mold can be used to produce finished fans of numerous diameters. The rotor pieces can be made from thin sheets of material conformed to shape on suitable molds, or the thickness of the rotor can be varied where needed by injection or compression molding the pieces, or using other suitable techniques.

In short, the advantages of the present invention include, but are not limited to, providing an improved fan for moving air or fluid within a conduit, or passing air through a filter or other mechanism. Further, the fan will successfully move a high volume of air or fluid with a reduced overall weight, and can be easily constructed from materials which will not corrode and will not produce sparks through inadvertent contact with a housing or nearby object. Additionally, the fan is durable yet economical to produce, and exhibits an extended useful life while reducing the need for maintenance, such as the removal of dirt, and obviates the need for the application of anticorrosive coverings.

BRIEF DESCRIPTION OF THE DRAWINGS

FIG. 1 is an upper perspective view of a radial tube centrifugal fan embodying the invention;

FIG. 2 is a bottom side plan view of the present invention, on a larger scale, illustrating the reinforcing ribs and sleeve of the present invention;

FIG. 3 is a cut-away elevational view of the invention taken generally along irregular line 3—3 shown in FIG. 2;

FIG. 4 is a partial cross-sectional view of an alternative embodiment showing a simple planar backing plate;

DETAILED DESCRIPTION OF THE INVENTION

Figure 5:
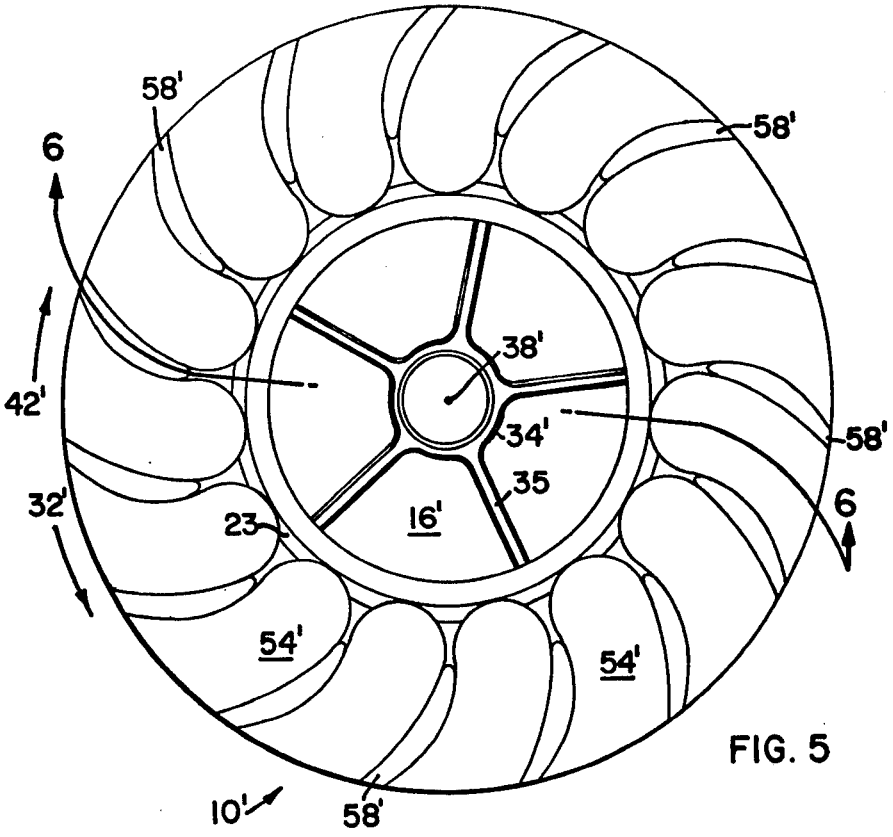
FIG. 5 is a top side plan view of the preferred embodiment.

In reference to the drawings, wherein like numerals indicate identical or corresponding structures throughout the several views, and more particularly to FIG. 1, the radial tube centrifugal fan 10 comprises a first or lower mating half 12 and a second or upper mating half 14. First mating half 12 is generally circular in shape having a centrally located planar backing plate 16, which is generally circular, and a plurality of spaced apart radially extending first half tubes 52 running in spoke-like fashion from the perimeter of backing plate 16 to the outer peripheral edge of first mating half 12. Each half tube has a body portion and a pair of spaced, planar edges, with the edges of adjoining half tubes being connected by webbing members 56. The first webbing members 56 comprise rigid connectors between each semicircular first half tube 52 on first mating half 12. The first webbing members 56 lie generally in a single plane parallel to the plane of backing plate 16, and spaced therefrom a distance approximately equal to the radius of first half tube members 52. Backing plate 16 has a reinforcement collar 34 formed at the center of backing plate 16 and concentric with the axis of rotation 38, which extends perpendicularly through the center of backing plate 16.

Second mating half 14, shown as the upper portion of rotor 10 in FIG. 1, has a circular entry port 18 located concentrically with axis of rotation 38 (see FIG. 3) having a dimension substantially equivalent to the diameter of backing plate 16 on first mating half 12. Extending outwardly in spoke-like fashion from the location of entry port 18 are semicircular second half tubes 54. Each semicircular second half tube 54 corresponds to a similar first half tube 52 located on first mating half 12. Second mating half 14 is provided with second webbing members 58 located between second half tubes 54 and serving to reinforce and locate second half tubes 54. Second webbing members 58 lie generally within a single plane parallel to the plane of entry port 18 and spaced therefrom a distance substantially equal to the radius of second half tubes 54. Entry port 18 is provided with bell flange 22 which comprises a slightly tapered surface, to entry port 18, facilitating the smooth convection of air drawn through entry port 18. Bell flange 22 channels air entering port 18 so that it enters tubes 26 near the center thereof. More specifically, the entry port 18 is defined by the bell flange member 22 which has an outer portion connected to the tubes 26, a circular rim portion around the entry port, and a ring-like depending flange portion having a cylindrical wall **22*a* substantially perpendicular to the entry port plane and extending toward the oppositely disposed backing plate 16. The cylindrical wall has an inner edge 22*b* disposed between the entry port plane and the plane of the centerlines to channel the fluid through the entry port 18 so that the fluid enters near the center of the circular cross sections of the tubes 26**.

The assembled rotor 10, having first mating half 12 and second mating half 14 connected as shown in FIG. 1, forms a radial tube centrifugal fan having radially extending tubes of substantially circular cross section. When assembled, entry port 18 is mounted in spaced relation to and in a plane parallel to backing plate 16. Assembly is accomplished by mating first half 12 with second half 14 and aligning first half tubes 52 with corresponding second half tubes 54. This task is accomplished by bringing first webbing members 56 into contact with second webbing members 58 forming fused coplanar webbing members 24 which lie in a plane parallel to and equidistant from the port 18 and plate 16. First webbing members 56 can be affixed either removably or permanently, with mechanical or chemical fasteners to second webbing members 58. Mechanical fasteners would include rivets or screws, or other similar devices, while chemical fasteners would include certain glues and solvents known in the bonding or fastening arts.

In operation, the rotor 10 would be rotated in a preferred direction illustrated by rotation arrow 32 and would draw nearby air through entry port 18, past bell flange 22, where the air would meet the innermost end of radial tubes 26 (each radial tube 26 being of the same length and comprised of a first half tube 52 mated or fastened to a corresponding second half tube 54 and having a diameter substantially equal to the distance between backing plate 16 and entry port 18) wherein the air would then be passed radially through the tube exiting in a direction perpendicular to the axis of rotation, at the perimeter of fan 10.

The radially extending tubes 26 each has an innermost end between the plate 16 and port 18, and each has a centerline comprising a series of points, each of which is the location of the center of the tube at that point. The innermost ends are located adjacent each other with the centerlines of said tubes lying in a single plane. The innermost ends are in contact with the innermost ends of adjacent tubes, and the innermost ends form a circle adjacent to and around the entry port 18.

In reference now to FIG. 2, the exterior surface of first or lower mating half 12 is shown comprising a plurality of radially extending first half tubes 52, with first webbing members 56 located between the adjacent first half tubes 52. Fasteners 44 are evenly spaced from each other so as not to affect the balance of rotor 10 about axis of rotation 38, and connect first webbing members 56 with second webbing members 58.

Reinforcement collar 34 and a captured drive sleeve 28 are shown coaxial with each other, and coaxial with axis of rotation 38 passing perpendicularly through the center of backing plate 16. Extending radially from, and continuous with reinforcement collar 34, are radially extending reinforcement ridges 36. Reinforcement ridges 36 extend below the surface of backing plate 16, and are spaced from each other in a symmetric relationship so as not to disturb the balance of rotor 10 about axis of rotation 38.

Bell flange 22 is shown in phantom lines in FIG. 2. Reinforcement ridges 36 extend from reinforcement collar 34 to slightly beyond the location of bell flange 22. Reinforcement ridges 36 are located on the outer surface of backing plate 16, so as not to interfere with the air flow passing through entry port 18 adjacent the opposite, or inner, surface of backing plate 16.

Arrow 32 indicates the direction of rotation during normal operation of the fan, wherein air is drawn through entry port 18 in a direction roughly parallel to the axis of rotation 38, and exits radial tubes 26 in a direction perpendicular to and away from, axis of rotation 38. Rotation of the fan in the direction of arrow 42 produces the same result, although the efficiency of the fan may be reduced.

It should be noted that in this embodiment each radial tube 26 extends directly outwardly from its origin between backing plate 16 and entry port 18 for a distance equal to less than its length. Each tube 26 then curves in a direction opposite to the direction of normal rotation (arrow 32) but remains within a single plane throughout its length. The centerlines of all the radial tubes 26 lie within a single plane which is the plane occupied by the fused webbing members 24.

As the component parts of rotor 10 are constructed, first mating half 12 and second mating half 14 are made of larger diameter than the finished dimension of the desired rotor 10. Since the rotor is assembled and then trimmed to the desired final diameter size, a single mold can be employed to produce rotors of numerous sizes, depending on how the finished rotor is trimmed. For this reason, the length of radial tubes 26, and the proportion of these tubes which extend directly outwardly (as described above) will vary slightly.

In reference now to FIG. 3, taken generally along irregular line 3—3 in FIG. 2, a cross section through fused webbing member 24 and a radial tube 26 are shown on either side of the backing plate 16. The flange 22, reinforcement collar 34 and ridges 36 are shown in FIGS. 1 and 2. The circular rim portion of bell flange 22 is configured to define with the depending flange portion **22*a* a smoothly flared entry port, and to further define an annular inwardly opening groove between the outer portion and the flange portion. Reinforcing ring 62 is a metal band or ring located in the groove under the circular rim portion of bell flange 22. Reinforcement ring 62 is positioned so as not to interfere with the air flow passing over bell flange 22, yet ring 62 substantially increases the strength of entry port 18**.

Metal drive sleeve 28 is coaxial with axis of rotation 38, and is molded into or press fit into collar 34. Sleeve 28 extends from the outermost dimension of bushing reinforcement ridges 36 substantially beyond both the plane of inlet opening 18 and the upper end of collar 34 and is provided with a set screw 29 for attachment of the fan 10 to a motor shaft, not shown. This arrangement allows the sleeve 28 to extend along the axis of rotation for a significant distance, adding to the stability of rotor 10 as sleeve 28 will surround the center of gravity of rotor 10. (The center of gravity is not shown in the drawings, but would lie somewhere along axis of rotation 38 between backing plate 16 and entry port 18.)

In reference now to FIG. 4, a partial view of a simplified backing plate **16*a* is shown as a substantially planar surface. Backing plate 16*a* has motor shaft receiver 48 as a circular opening located in the center of backing plate 16*a* and concentric with axis of rotation 38*a*. Rotor attachment openings 46 are drilled through backing plate 16*a* so as to facilitate mounting rotor 10 to a motor flywheel or similar rotational power source, not shown. FIG. 4 illustrates a configuration of rotor attachment openings 46 wherein three such openings are located in backing plate 16*a*. Each rotor attachment opening 46 is located equidistant from axis of rotation 38*a***, each lying exactly 120 degrees of arc from each adjacent rotor attachment opening. Other suitable configurations might be necessary for a particular application of the rotor.

DESCRIPTION OF THE PREFERRED EMBODIMENT

Figure 6:
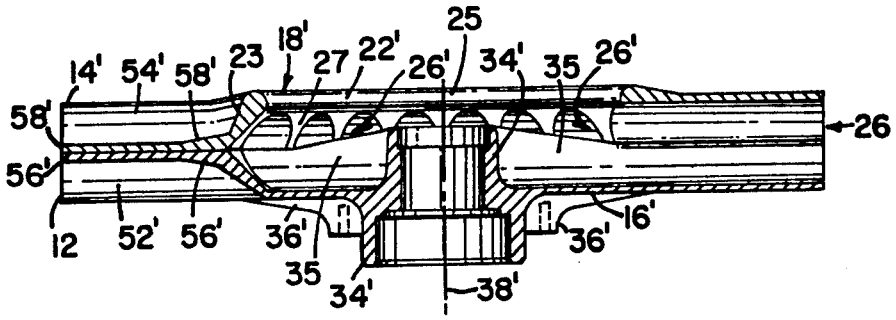
FIG. 6 is a cut-away elevational view of the preferred embodiment taken along irregular line 6—6 in FIG. 5.
Figure 7:
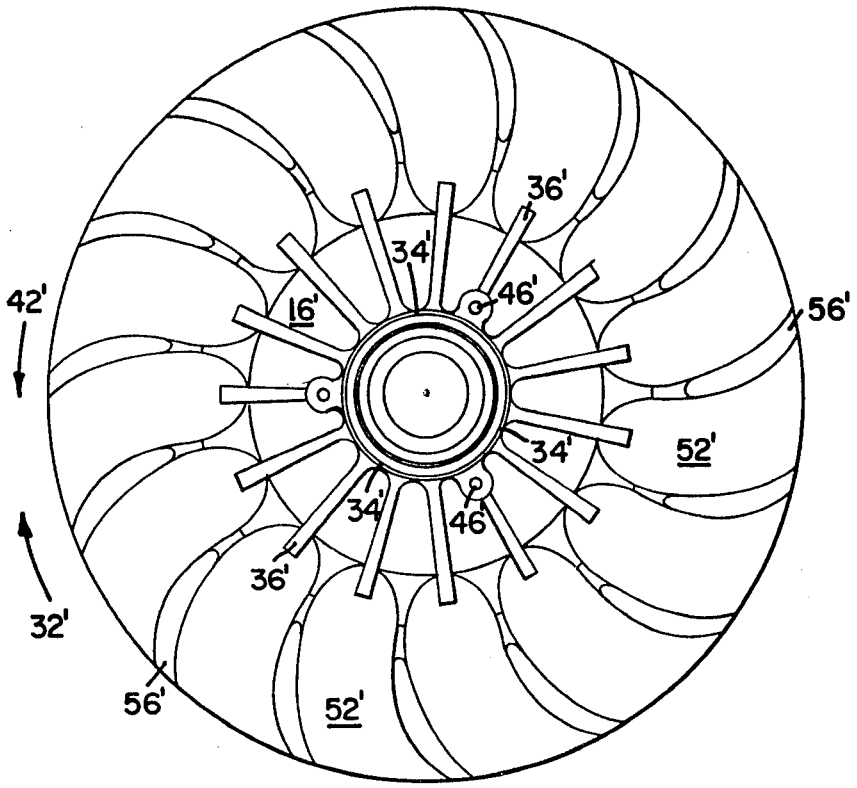
FIG. 7 is a bottom side plan view of the preferred embodiment.

In reference to FIGS. 5, 6 and 7 wherein primed numerals indicate corresponding structures to those shown in FIGS. 1–4, the radial tube centrifugal fan 10' comprises a first or lower mating half 12' and a second or upper mating half 14'. First mating half 12' is generally circular in shape having a centrally located planar backing plate 16', which is generally circular. The first half 12' has a plurality of spaced apart radially extending first half tubes 52' running in spokelike fashion from the perimeter of backing plate 16' to the outer peripheral edge of first mating half 12'. Each half tube has a body portion and a pair of spaced, planar edges, with the edges of adjoining half tubes being connected by webbing members 56'. The first webbing members 56' comprise rigid connectors between each semicircular first half tube 52' on first mating half 12'. The first webbing members 56' lie generally in a single plane parallel to the plane of backing plate 16', and spaced therefrom a distance approximately equal to the radius of first half tube members 52'. Backing plate 16' has a reinforcement collar 34' formed at the center of backing plate 16' and concentric with the axis of rotation 38', which extends perpendicularly through the center of backing plate 16'.

Second mating half 14', has a circular entry port 18' located concentrically with axis of rotation 38' and having a dimension substantially equivalent to the diameter of backing plate 16' on first mating half 12'. Extending outwardly in spoke-like fashion from the location of entry port 18' are semicircular second half tubes 54'. Each semicircular second half tube 54' corresponds to a similar first half tube 52' located on first mating half 12'. Second mating half 14' is provided with second webbing members 58' located between second half tubes 54' and serving to reinforce and locate second half tubes 54'. Second webbing members 58' lie generally within a single plane parallel to the plane of entry port 18' and spaced therefrom a distance substantially equal to the radius of second half tubes 54'. Entry port 18' is provided with a flange member 22' which has an outer portion 23 connected to the tubes 26', a circular rim portion 25 around the entry port, and an inner portion 27. Flange member 22' allows air entering entry port 18' to pass smoothly through the entry port 18' and arrive at the innermost ends of tubes 26'. The preferred embodiment shown in FIGS. 5–7 differs from the embodiment shown in FIGS. 1–4 in that no ringlike depending flange and no cylindrical wall are provided.

Flange member 22' is conformed so that outer portion 23 smoothly connects to the inner ends of half tubes 54', and smoothly connects with the second webbing members 58'. Circular rim portion 25 encircles entry port 18' and defines a smoothly rounded circular flange which descends from the portion of entry port 18' farthest from backing plate 16' to the portion of entry port 18' having the greatest circumference. Inner portion 27 smoothly extends from the portion of entry port 18' having the smallest circumference to the internal surface of each second half tube 54'. Inner portion 27 of flange member 22' has a fluted or scalloped configuration as it passes around the semicircular openings of each second half tube 54' and connects with each second webbing member 58' between each half tube 54'. Circular rim portion 25 and inner portion 27 smoothly direct the flow of air through entry port 18' as it enters the inner ends of tubes 26'.

The assembled rotor 10', having first mating half 12' and second mating half 14' forms a radial tube centrifugal fan having radially extending tubes of substantially circular cross section. When assembled, entry port 18' is mounted in spaced relation to and in a plane parallel to backing plate 16'. Assembly is accomplished as described above with reference to FIGS. 1–4.

In operation, the preferred embodiment of the rotor 10' would be rotated in a preferred direction illustrated by rotation arrow 32' and would draw nearby air through entry port 18', past bell flange 22', where the air would meet the innermost ends of radial tubes 26' (each radial tube 26' being of the same length and comprised of a first half tube 52' mated or fastened to a corresponding second half tube 54' and having a diameter substantially equal to the distance between backing plate 16' and entry port 18') wherein the air would then be passed radially through the tube exiting in a direction perpendicular to the axis of rotation, at the perimeter of fan 10'.

The radially extending tubes 26' each has an innermost end between the plate 16' and port 18', and each has a centerline as described above with reference to FIGS. 1–4. The innermost ends are located adjacent each other with the centerlines of said tubes lying in a single plane. The innermost ends are in contact with the innermost ends of adjacent tubes, and the innermost ends form a circle adjacent to and around the entry port 18'.

Reinforcement collar 34' is conformed to receive a driving shaft (not shown) and serves as the inner terminus for the inner reinforcement ridges 35 (see FIG. 5). Each inner ridges 35 lies between the backing plate 16' and entry port 18', extends radially from and is continuous with the reinforcement collar 34', and extends to and is aligned with one of the webbing members 56' on first mating half 12'. There are five inner reinforcement ridges 35 each spaced 72 degrees of arc from adjacent inner reinforcement ridges 35, (see FIG. 7), and are spaced to not upset the balance of rotor 10' about axis 38'. Further, ridges 35 are aligned to contact corresponding webbing members 56'. This configuration strengthens rotor 10' and its attachment to the driving shaft (not shown).

Located on the opposite side of backing plate 16' from inner reinforcement ridges 35 are outer reinforcement ridges 36' (see FIG. 7). The outer reinforcement ridges 36' are continuous with and extend radially outwardly from the portion of the reinforcement collar 34' below the surface of backing plate 16'. Outer reinforcement ridges 36' are spaced 24 degrees of arc from each other, and fifteen outer ridges 36' extend from reinforcement collar 34' to slightly beyond the perimeter of backing plate 16'. Each outer reinforcement ridge 36' extends to just beyond the middle of the inner end of one radial half tube 52'. This allows each tube 26' to be supported and stabilized by one of the fifteen outer reinforcement ridges 36'.

Three of the fifteen outer reinforcement ridges 36' are provided with rotor attachment openings 46' which provide a ready means of attachment for the rotor 10' to a flywheel or motor output shaft (not shown). It should be noted that the internal configuration of reinforcement collar 34' (coaxial with axis of rotation 38') allows for a snug fit of reinforcement collar 34' to a motor output shaft (not shown). The configuration shown is one possible configuration, other suitable shapes for reinforcement collar 34' could easily be adapted.

Arrow 32' indicates the direction of rotation during normal operation of the fan, wherein air is drawn through entry port 18' in a direction roughly parallel to the axis of rotation 38', and exits radial tubes 26' in a direction perpendicular to and away from, axis of rotation 38'. Rotation of the fan in the direction of arrow 42' produces the same result, although the efficiency of the fan may be reduced.

Two embodiments of our invention have been described above. Those skilled in the art will no doubt be able to utilize the principles of this invention other than as specifically described above. Therefore, it is to be understood that the scope of the invention is to be limited only by the following claims.

What is claimed is:

1. A radial tube centrifugal fan comprising:

a planar backing plate having an axis of rotation perpendicular to said plate, and a perimeter;

first means defining an entry port mounted in spaced relation to and in a plane parallel to said backing plate;

means for mounting a plurality of radially extending tube means between said first means and said backing plate for drawing a fluid through said port and outwardly through said tube means during rotation of said fan about said axis of rotation in a preferred direction, said tube means each being of generally circular cross section and extending radially outwardly from said perimeter of said backing plate, said tube means each being of a diameter substantially equal to the distance between said backing plate and said entry port, and each said tube means having an end between said plate and said port;

said tube means including radially extending tubes, each having an innermost end and a centerline, each said centerline comprising a series of points, each of which is the location of the center of said tube at said point, said innermost ends being located adjacent each other with said centerlines of said tubes lying in a single plane, said innermost ends being in contact with the innermost ends of adjacent tubes, and said innermost ends forming a circle adjacent to and around said entry port;

said means defining said entry port including a bell flange means having an outer portion connected to said tubes, a circular rim portion and a depending flange portion extending toward said oppositely disposed backing plate; and said circular rim portion being configured to define with said depending flange portion a smoothly flared air inlet port, and to further define an annular inwardly opening groove between said outer portion and said flange portion, said groove having a reinforcing ring mounted therein to reinforce said bell flange means.

2. The fan of claim 1 further wherein:

said means defining said entry port includes a ring-like flange member having a cylindrical wall substantially perpendicular to said entry port plane; and said cylindrical wall has an inner edge disposed between said entry port plane and said plane of said centerlines to channel said fluid through said entry port so that said fluid enters near the center of said innermost ends of said tubes.

3. A radial tube centrifugal fan comprising:

a planar backing plate having an upper surface and a lower surface, and having an axis of rotation perpendicular to said plate, and a perimeter;

first means defining an entry port mounted in spaced relation to and in a plane parallel to said backing plate; and means for mounting a plurality of radially extending tube means between said first means and said backing plate for drawing a fluid through said port and outwardly through said tube means during rotation of said fan about said axis of rotation in a preferred direction, said tube means each being of generally circular cross section and extending radially outwardly from said perimeter of said backing plate, said tube means each being of a diameter substantially equal to the distance between said backing plate and said entry port, and each said tube means having an end between said plate and said port;

said backing plate having an opening located coaxial with said axis of rotation of said backing plate; and said backing plate having mounting means including a collar surrounding said opening on said backing plate for mounting said fan to a rotational power source; and a plurality of radially extending inner reinforcement ridges each having an inner terminus, said ridges lying on and rising above said upper surface of said backing plate, and terminating in said collar, said collar being continuous with said inner terminus of said inner reinforcement ridges, said inner reinforcement ridges extending radially outwardly at least to said perimeter of said backing plate.

* * * * *